United States Patent [19]

Howard et al.

[11] 4,136,919

[45] Jan. 30, 1979

[54] ELECTRICAL RECEPTACLE WITH RELEASABLE LOCKING MEANS

[76] Inventors: Guy W. Howard, #3-1598 Sir Francis Drake Blvd., San Anselmo, Calif. 94960; Brian W. Dodd, 46 Juniper Rd., San Geronimo, Calif. 94973

[21] Appl. No.: 848,493

[22] Filed: Nov. 4, 1977

[51] Int. Cl.[2] ..... H01R 13/54

[52] U.S. Cl. ..... 339/75 P; 339/80; 339/91 R

[58] Field of Search ..... 339/37, 38, 45, 46, 339/74 R, 75 R, 75 M, 75 P, 91 R, 80, 82, 89 R, 89 M; 200/50 B, 61.08

[56] References Cited

U.S. PATENT DOCUMENTS

| | | | |
|---|---|---|---|
| 2,664,734 | 1/1954 | McEneaney | 339/37 |
| 2,704,831 | 3/1955 | Smith | 339/75 P |
| 2,732,531 | 1/1956 | Janowiec | 339/91 R |
| 2,847,652 | 8/1958 | Kokalas | 339/45 M |
| 3,489,989 | 1/1970 | Robaczewski | 339/75 P |
| 4,060,297 | 11/1977 | Marshall et al. | 339/37 |

*Primary Examiner*—Neil Abrams
*Attorney, Agent, or Firm*—Thomas M. Freiburger

[57] ABSTRACT

An electrical cord connecting receptacle, which may be of the grounding type, incorporates a mechanism which locks the current carrying conductor blades of a plug or cap to the current carrying conductors of the receptacle. The locking mechanism prevents the cap from being accidentally withdrawn from the receptacle under normal conditions of use. Through the use of spring-biased pins positioned to engage holes in the cap blades, the device provides for snap-in receipt of the cap blades, release of the cap by manual release of the pins, and emergency release by an unusually heavy pull on the cap.

8 Claims, 8 Drawing Figures

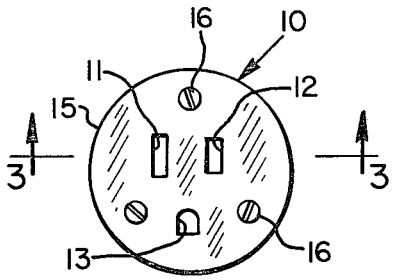
FIG. 1
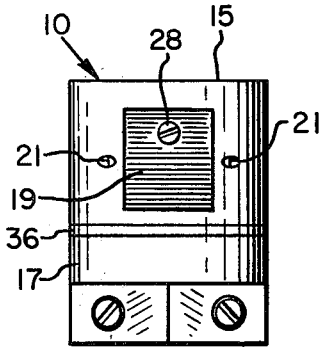
FIG. 2
FIG. 3
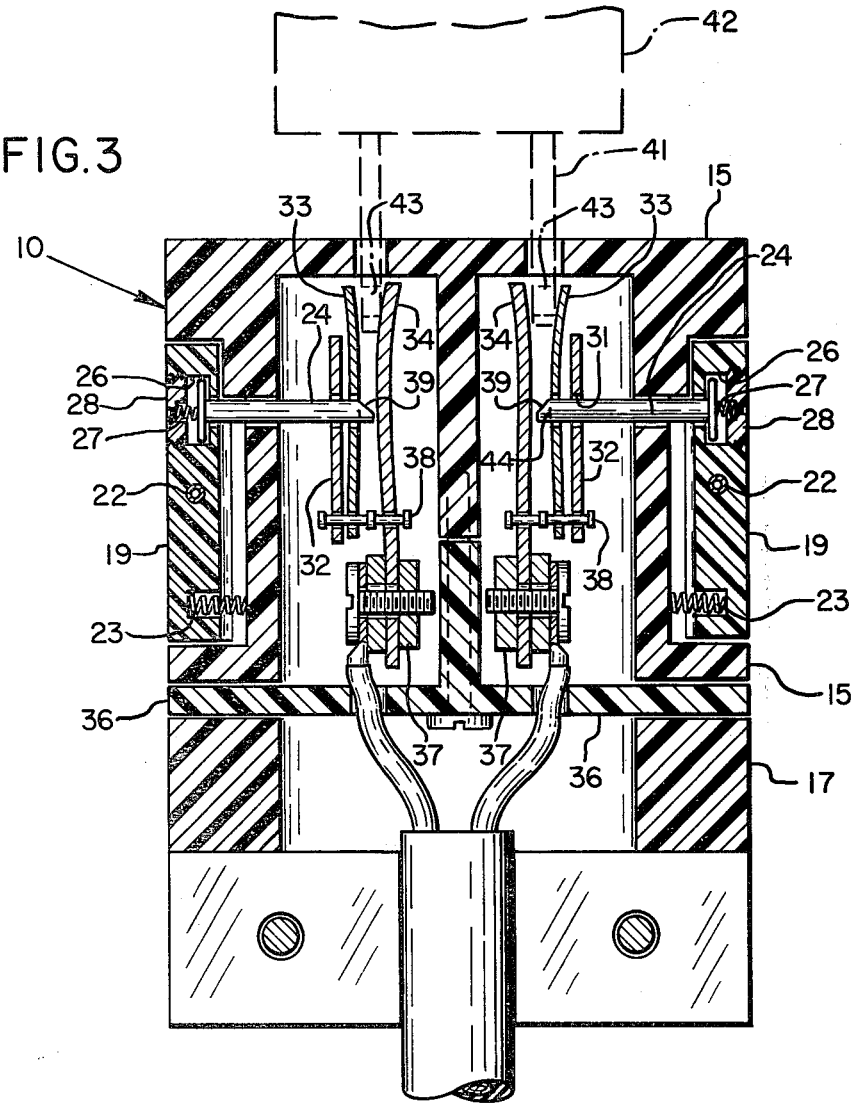

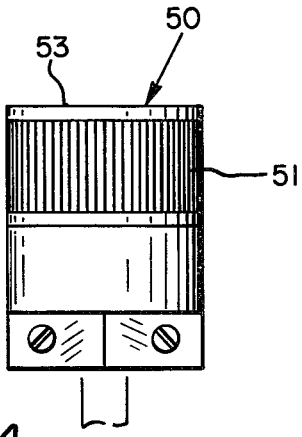
FIG.4
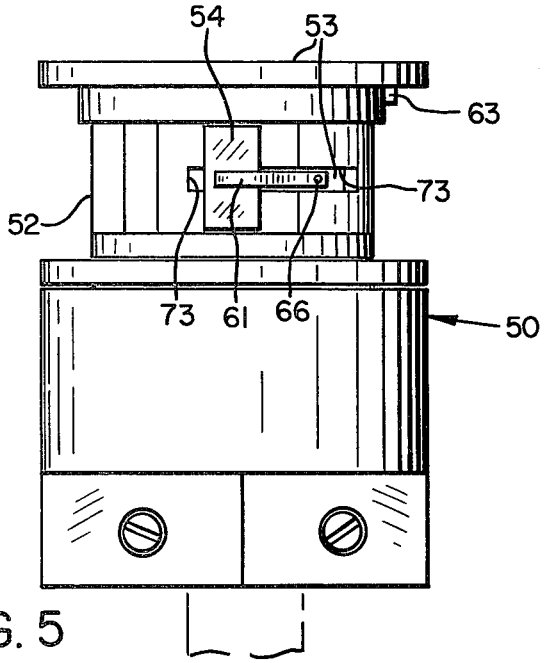
FIG. 5
FIG. 6
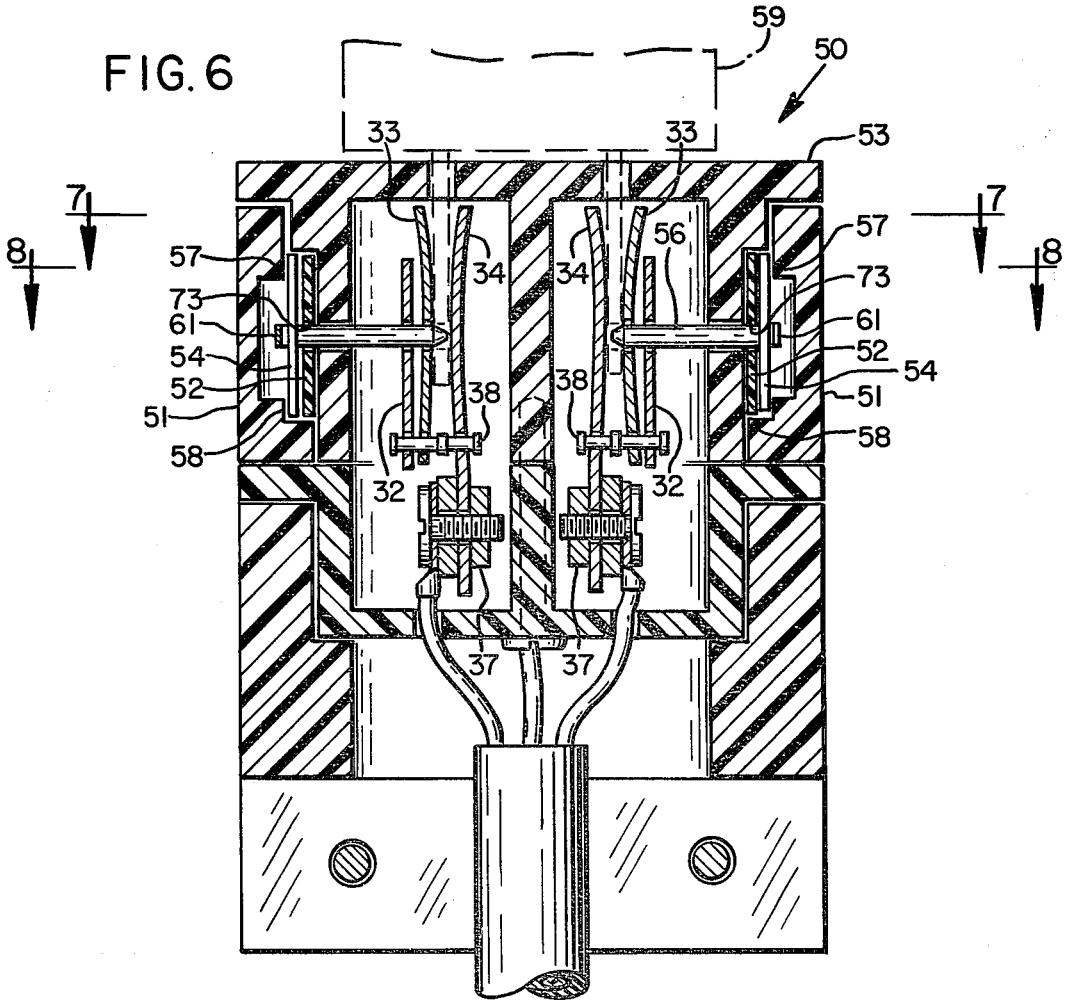

ELECTRICAL RECEPTACLE WITH RELEASABLE LOCKING MEANS

BACKGROUND OF THE INVENTION

The invention relates to electrical cord connecting apparatus, and more particularly to an electrical receptacle with a releasable locking means for a plug, or cap.

Several types of locking electrical receptacles, for preventing accidental withdrawl of a cap from the receptacle when some tension is introduced into the electrical cords, have been suggested previously. For example, Carissimi et al U.S. Pat. No. 3,801,757 disclosed a connector having a releasable locking means that locked the heavy duty male connector to the receptacle through slots in the face of the receptacle, for safety purposes Bissell U.S. Pat. No. 2,015,543 suggested the use of a manually operated device that mechanically locked the male connector in place when inserted in the receptacle and also actuated a switch. This assured that power was off whenever the connectors were separated, so that arcing could not occur. There have also been designed special flanged cap blades and corresponding structure in a receptacle, such that the cap was pushed in and then twisted in a clockwise direction to lock it in place. This of course required replacement of both caps and receptacles by one who desired to change over to a locking system.

Graf U.S. Pat. No. 1,019,455 disclosed a locking device which utilized apertures in the prongs of the plug connector. The locking device was actuated by a switch knob on the receptacle.

None of the locking devices suggested in the prior art was as fast and efficient in operation, as safe, versatile, and as efficiently constructed as the improved locking receptacle described below.

SUMMARY OF THE INVENTION

The present invention provides several embodiments of a cap locking electrical receptacle wherein the cap blades are locked automatically into the receptacle upon insertion and are released only by manual action or by a pull of such magnitude as to activate an emergency release mechanism. The receptacle is relatively simple in construction and highly convenient to use.

In each embodiment, the receptacle includes a pair of locking pins, each of which passes transversly into the space between the two conductors which receive a cap blade between them. The lock pin is urged into this space, at the position where the opening of a standard cap blade would be when inserted, by the action of a spring near the periphery of the receptacle. Each lock pin has an angled camming surface at its tip so that when inserted, the cap blades will push the lock pins aside until the blade openings are in position to receive the lock pins therethrough. In each embodiment, normal release of the cap from the receptacle is accomplished by a manual operation on the receptacle which retracts or releases the lock pins. Also in each embodiment, means are provided for emergency release of the cap under excessive force. This may occur for example, if a force is accidentally applied to the cord to which the cap is connected, the force being strong enough to pull the wiring out of the cap or break the wiring if the cap would not release; this is the principle situation to which the emergency mechanism is addressed.

In the first embodiment of the invention, a pair of pivotal release levers are located at opposite positions on the outside of the receptacle, such that when the ends of the levers are depressed, they retract the pins. In this embodiment the ends of the pins are partially weakened so as to be shearable off under the excessive force discussed above.

In a second embodiment of the invention, the pins are locked in place under the influence of a relatively stiff spring by a manual operation after the insertion of the cap blades. An outer lock ring on the receptacle is rotated to a position wherein the springs are activated to hold the lock pins within the cap blade openings under normal conditions. However, the ends of the lock pins are tapered at both edges, or are frustoconical, so that the pins can be forced into retracted position by a pull of sufficient (emergency) magnitude on the cap. Also in this embodiment, the pins may be manually retracted and held to use the receptacle with no locking means, by a reverse rotation of the outer ring on the receptacle.

Accordingly, it is among the objects of the invention to provide an electrical receptacle of relatively simple construction, but which efficiently retains a cap in the receptacle when desired under normal conditions, which is readily releasable by a manual operation, and which provides for emergency release of the cap from the receptacle under an unusually heavy pulling force applied to the cap. These and other objects, advantages, features of the invention will be apparent from the following detailed description, taken in conjunction with the accompanying drawings.

DESCRIPTION OF THE DRAWINGS

FIG. 1 is an end view of an electrical receptacle according to the invention.

FIG. 2 is a side view of the receptacle.

FIG. 3 is a sectional view of the receptacle taken along the line 3—3 of FIG. 1.

FIG. 4 is a side view of a second embodiment of an electrical receptacle according to the invention.

FIG. 5 is an enlarged view of the receptacle shown in FIG. 4, with a peripheral lock ring removed.

FIG. 6 is a sectional view of the receptacle of FIG. 4, similar to FIG. 3 showing the first embodiment.

DESCRIPTION OF THE PREFERRED EMBODIMENTS

Figure 7:
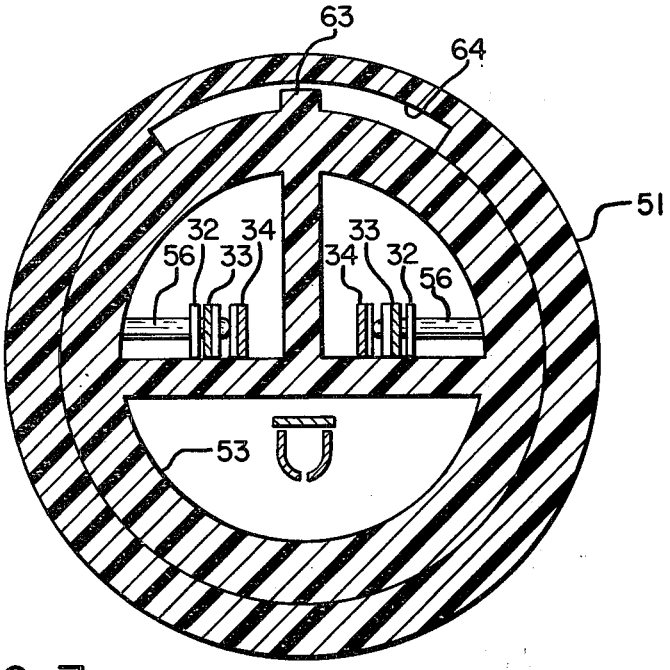
FIG. 7 is a sectional view of the receptacle of FIG. 4, taken along the line 7—7 of FIG. 6.

FIGS. 1, 2 and 3 show a first embodiment of the invention. In FIG. 1, a receptacle 10 of the type for connection onto the end of a cord, is shown in end view, with sockets 11 and 12 for insertion of current-carrying conductors of a plug or cap and a socket 13 which may optionally be provided for a ground. Visible in FIG. 1 is a receptacle body 15 which, by means of screws, bolts or other fasteners 16, is attached to a cable clamp and base assembly 17 seen in FIG. 2.

Also seen in FIG. 2 is one of two lock release levers 19 which is engaged in its lower part (i.e., the lower end as viewed in FIG. 2) by finger and thumb of the operator to release the electrical plug, or cap (not shown in this view), when desired. The operation and further structure of these levers 19 will be discussed with reference to FIG. 3, but FIG. 2 shows the ends of a roll pin bearing 21 which is press-fit through a chord-oriented bore in the cylindrical body 15. The roll pin bearing 21 is the pivot for the lever 19, with a similar assembly being located on the other side of the housing.

FIG. 3 shows the pivot pins 22 and the lock release lever 19 in sectional view. Lever return springs 23 hold the levers 19 in their normal position shown, but depression of the lower ends (i.e. lower as viewed in FIG. 3) of the levers by an operator will pivot the levers, thereby swinging their upper ends outwardly. These upper ends are attached as shown to slidable locking pins 24. Each pin is retained by a cavity 26 in the lever, with a lock pin spring 27 urging the pin toward its locking position. The spring 27 is seated against the inside of a screw-in cover 28 which facilitates the removal and replacement of the pin when necessary. The cover 28 is also seen in FIG. 2.

The pins 24 pass through guide openings 29 in the housing and 31 in a pin alignment guide 32. They also pass through outer conductors 33 and reach close to inner conductors 34 as shown. The current carrying conductor pairs are typically arranged, with the inner conductors 34 suitably mounted to an insulative contact assembly base, as by mounting brackets 37. The conductor pairs (conductors 33 and 34) are suitably attached together, and to the pin alignment guide 32 as by rivets 38.

As indicated, each locking pin end 39 is tapered or beveled, at an angle as shown in FIG. 3, so that the blades 41 (phantom) of a cap 42 (phantom) will cam the pins outwardly as the blades are pushed into the receptacle. When the cap is substantially all the way into the receptacle, holes 43 (phantom), as are typically provided in cap blades, align with the lock pins 24 and the pins snap into them under the influence of the lock pin springs 27. The pins 24 thus hold the cap 42 firmly in place in the receptacle, against light and moderate forces in the electrical cords which would tend to pull the cap out of the receptacle.

To release the cap 42, an operator need only squeeze in on the lock release levers 19, below the pivot pins 22 and pull the cap out.

If an excessive force is applied to the cap 42 tending to pull it out, as when the cord is pulled so hard that it might pull out from the cap or break the wires, provision is made for emergency release of the cap. In this embodiment a shear line or plane 44 is provided in each lock pin 24, approximately in line with the face of the outer conductor 33, so that a strong force will shear the tips off the pins. If this occurs, the lock pin covers 28 can be removed to replace the pins.

It should be understood that although what has been described is the preferred arrangement for the locking and emergency release functions of the lock pins 24, other arrangements are also suitable. For example, the lock pin spring 27 on each side could be eliminated, with the head of the lock pin held closely in the lever 19, allowing almost no axial movement of the pin relative to the lever, but with provision for slight pivotal movement of the pin head in the lever (arrangement not shown). In this way, the lever return springs 23 would act to urge the pins to their engaged positions, and when the pins are cammed aside, the levers would pivot. Other emergency release means can also be provided, as for example by providing for pivoting of the pins 24 about their heads, toward the receptacle entrance, under an extreme pull on the cap blades. A heavy spring (not shown) could hold the pins in their normal position, and return them after they are free of the cap blade holes during emergency release. This would avoid the need for replacement of shearable pins, but would require some slotted openings, as in the outer conductors 33, the guides 32 and a portion of the housing 15.

Below the contact assembly base 36 is the cable clamp and base assembly 17, as on typical cord-connected receptacles. The fasteners 16 may extend through the receptacle body and through the contact assembly base 36 (which is separate and removable along with the conductors and guides 32), to the cable clamp and base assembly 17.

A second embodiment of a receptacle 50 shown in FIGS. 4 through 8 function in essentially the same manner as the first described embodiment. I.e., it locks a cap into itself by means of pins which engage the holes typically provided in the cap blades, is manually releasable, and has emergency release means for extraordinarily heavy pulling forces. However, different means are provided for accomplishing these results. A lock ring 51 is rotated in one direction to lock the blades in place and the other direction to release them, and the emergency release resets automatically, without any need for pin replacement. Also, the lcoking pins may be manually retracted to operate the receptacle in a non-locking mode or to free the cap blades from the pins if they should for some reason stick.

FIGS. 5, 6, 7 and 8 show the internal structure of the receptacle 50. In FIG. 5 the lock ring 51 is removed to reveal a retraction ring 52 inside, which is also rotatable about the receptacle body 53, inside the lock ring 51. The active part of the locking mechanism is a pair of lock pin and spring units, of which one lock spring 54 is visible in FIG. 5. It is a flat spring, acting by flexure through its length, or height as viewed in FIGS. 5 and 6. As shown in FIG. 6, the lock spring may be integral with the lock pin 56, which extends through similar guiding structure to that described above in connection with the first embodiment. The lock spring 54 is relatively stiff, and normally holds the lock pin 56 in the blade locking position shown by bearing against upper and lower ridges 57 and 58 of the lock ring 51. In this embodiment the inner conductors 34 may be made somewhat stiffer than the outer conductors 33 to prevent the inner conductors from camming inwardly to free the cap blades when this is not desired.

When an unusually heavy force is applied to pull out the cap 59 (phantom), however, the spring 54 will deflect outwardly under the camming action of the receptacle blades. As shown in FIG. 6, the tip of the pin 56 is beveled at both edges, or frustoconical, so that both edges can be cammed. The reason for this will be explained below.

The lock pin and spring units, each including the pin 56 and the spring 54, may be of a suitable plastic or metal material. If they are not integrally molded, they can be welded or connected together by fasteners.

Figure 8:
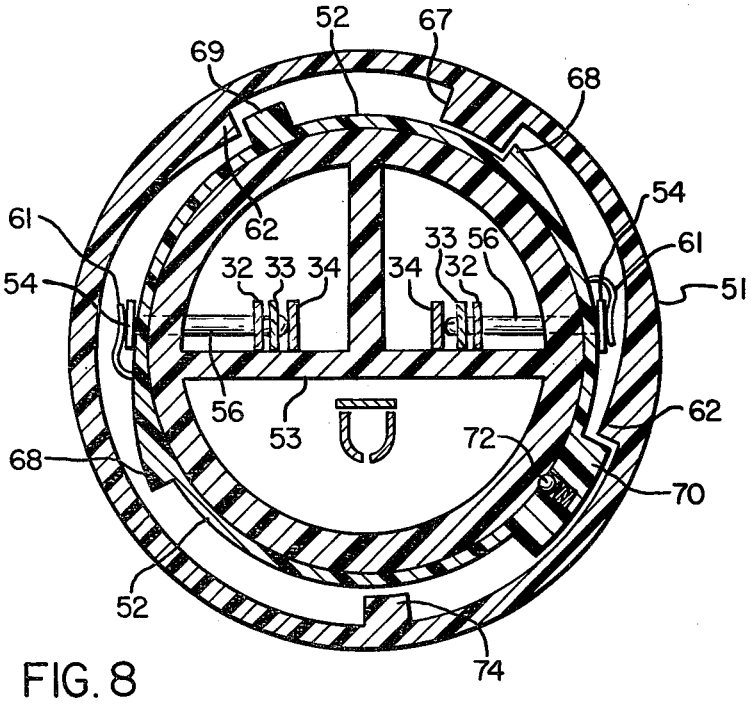
FIG. 8 is a sectional view of the same receptacle taken along the line 8—8 of FIG. 6.

FIG. 6 of course shows the locking position of the receptacle 50. In the unlocked position, the lock pin 56 and spring 54 still remain in the position shown, under the influence of a light pin-retaining leaf type spring 61, but the lock ring is rotated and the ridges 57 and 58 are retracted. FIG. 8 shows the retracted, non-locking position of the ring 51, indicating that the lock ring has pairs of upper and lower (only upper being visible) tapered inner surfaces or cams 62 that form the ridges 57 and 58 and which engage the lock springs 54 only when the lock ring is rotated counterclockwise from the position shown in FIG. 8. Limits to the angle of movement of the lock ring 51 are provided by a lock ring stop 63 on the receptacle body, shown in the sectional view of FIG. 7. The stop 63 resides in a cut out arcuate channel 64 at the upper inside edge of the lock ring. FIG. 5 shows the stop 63 on the receptacle body.

FIG. 5 also shows the light pin retaining spring 61, connected to the receptacle body 53 at one end by a suitable fastener 66.

Another ring, rotatable on the housing and inside the lock ring, is visible in FIG. 8. This is the retraction ring 52, also seen in FIGS. 5 and 6. The purpose of this ring is to retract the lock pins 56 outwardly and hold them retracted when desired. To accomplish this, the lock ring 51 is rotated clockwise, as viewed in FIGS. 7 and 8, beyond its normal non-locking position shown in FIG. 8. The normal non-locking position is also shown in FIG. 7, indicating that the lock ring can rotate further clockwise in its permitted angle of movement. Such further rotation will rotate the retraction ring as well, since a lock ring projection 67 (FIG. 8) will abut against the back edge of a cam 68 on the retraction ring, and the blunt ends of the lock ring tapers 62 will abut against projections 69 and 70 on the retraction ring. However, there should be some resistance against such further clockwise movement, so that the operator can "feel" the position of the retraction ring, even though he is unable to see it (an exterior visual indicator could be provided, but is preferably not, in the interest of simplicity). The resistance can be provided by a spring ball and detent assembly 72 as shown in FIG. 8, positioned to normally hold the retraction ring 52 in its normal position at the counterclockwise end of its range of movement.

On the retraction ring a second cam 68 is included, both cams being positioned to engage and push the lock springs 54 and lock pins 56 outwardly, removing them from the paths of the cap blades (rotated position not shown), when the ring 52 is rotated clockwise. As shown in FIGS. 5 and 6, the lock pins pass through slotted openings 73 in the retraction ring, as does the light leaf spring 61, so that the necessary movement of the retraction ring is permitted.

To return the lock pins 56 to their normal position, the lock ring 51 must be rotated counterclockwise not only to its normal unlocked position shown in FIG. 8, but beyond that to the locked position, thereby moving the retraction ring as well by catching the lock ring projection 67 on the retraction ring projection 69, and a lock ring projection 74 on the retraction ring projection 70. When the retraction ring reaches its normal position shown in FIG. 8, the spring ball and detent assembly 72 re-engages and snaps it into place. Following this, the operator moves the outlying lock ring back clockwise to the position shown in FIG. 8, whence he can feel the resistance of the lock ring hitting the retraction ring.

To utilize the locking receptacle 50 of the invention, the operator simply inserts a standard electrical cap from a cord leading to a portable tool, etc. Normally the blades of such a cap have openings near their tips. As the blades are pushed into the receptacle, which is in its normal unlocked position, the blades push against the tapered lock pin tips and cam them aside, against the light force of the pin retaining springs 61. When the blades are nearly completely into the receptacle, the blade holes align with the pins and the pins snap into place. At this point the blades are lightly held in place in the receptacle, since the cap can be pulled out with the same force with which it was pushed in. Under some circumstances this mode may be all that is required, but this is not what is referred to as the "locked" position herein and in the claims since the cap may be removed with little force. The main function of this normal unlocked receptacle position is to be sure the cap blades are correctly positioned before the lock ring is rotated to the locked position. When the lock pins snap into place, the operator hears and feels this and knows that the lock ring may be rotated to the locked position.

The operator grips the cap in one hand and the lock ring of the receptacle in the other, and rotates them relative to one another in the same manner and direction as prior art locking devices wherein both the receptacle and the cap blades were specially designed to lock by a twist after insertion.

With the lock ring in locking position, only a pull of unusual magnitude will remove the cap from the receptacle.

When the cap is to be removed, the lock ring is rotated in the opposite direction, again requiring the same motions involved in releasing a twist type locking device of the prior art. The ring is rotated to the normal unlocked position (shown in FIG. 8), where the operator feels it abut against the retraction ring inside. In the unlikely event that the cap is difficult to remove, the lock pins may possibly be stuck to the cap blades (as by arcing if the pins are metal.) The pins may be freed by further rotation of the lock ring, thereby rotating the retraction ring 52 and camming the lock pins outwardly.

If desired, the retraction ring can be left in this position, and the receptacle operated in a standard, non-locking mode. Otherwise the device can be reset to normal position by rotation of the lock ring back to the locking position, then back about half way to the normal unlocked position shown in FIG. 8. Exterior indicators (not shown) are preferably provided on the lock ring and the receptacle body to show which of the three positions the lock ring is in. Thus, the lock ring position is always apparent, and the position of the retraction ring inside can be determined by feel of the ball and detent and feel of resistance to movement of the lock ring caused by the retraction ring.

Except for fasteners, springs, pivot pins, etc., and conductors, all components of the two embodiments described are preferably of a relatively rigid plastic material. The lock pins may be either plastic or metal, as noted above.

The above described preferred embodiments provide electrical receptacles which firmly lock a standard cap in place, yet release automatically under an excessive pulling force. Complex and expensive apparatus are avoided. Various other embodiments and modifications of these preferred embodiments will be apparent to those skilled in the art and may be made without departing from the spirit and scope of the invention as defined by the following claims.

We claim:

1. An electrical receptacle adapted to lock a cap to itself by engaging the holes in the blades, comprising:

a receptacle body having slots for insertion of the cap blades and conductors inside for engaging against the cap blades;

a pair of locking pins slidably mounted within the receptacle body so as to be aligned with the respective cap blade holes;

a pair of lock pin spring means, one acting on each pin, urging the pin toward the position of engagement with the cap blade holes, said pins having blade-engaging ends which are tapered on the side toward the blade slots of the receptacle so that insertion of the blades cams the pins out of the paths of the blades, against the urging of the lock pin spring means, whereby insertion of the blades automatically causes the pins to retract and then engage the blade holes;

means for manually retracting the pins when it is desired to remove the cap from the receptacle, comprising a pair of lock release levers pivotally mounted on the receptacle body, one at each pin, each lever having one end connected to the lock pin, with spring means biasing the lever toward a normal position wherein the pin is in an engaged position, said lock pin spring means bearing against a portion of the lock release lever, said lock pin being slidable within the lock release lever between a normal and a pin-retracted position; and emergency means for releasing the cap blades from the pins when a predetermined degree of pulling force is applied to the cap.

2. The receptacle of claim 1 wherein said portion of the lock release lever comprises a threaded lock pin cover, removable by unscrewing to enable the pin to be removed and replaced.

3. A cord-mounted electrical receptacle adapted to lock a cap to itself by engaging the holes in the blades, comprising:

a receptacle body having slots for insertion of the cap blades and conductors inside for engaging against the cap blades;

a pair of locking pins slidably mounted within the receptacle body so as to be aligned with the respective cap blade holes;

means for engaging the pins in the holes comprising a rotatable lock ring mounted on the periphery of the receptacle body and adapted to be manipulated by the hand of an operator, said lock ring having camming means for locking the pins in the engaged position when the lock ring is rotated in one direction from a normal non-locking position to a locking position;

means for manually retracting the pins by rotation of the lock ring when it is desired to remove the cap from the receptacle; and emergency means associated with the pins for releasing the cap blades from the pins in response to a predetermined degree of pulling force applied to the cap.

4. The receptacle of claim 3, including spring means coacting between the camming means and the locking pins, and wherein said emergency means comprises tapered tip means on the locking pins for camming the pins out of the cap blade holes upon application of said predetermined degree of pulling force, so that the cap is released even though the lock ring is in the locking position.

5. An electrical receptacle adapted to lock a cap to itself by engaging the holes in the blades, comprising:

a receptacle body having slots for insertion of the cap blades and conductors inside for engaging against the cap blades;

a pair of locking pins slidably mounted within the receptacle body so as to be aligned with the respective cap blade holes;

means for engaging the pins in the holes comprising a rotatable lock ring mounted on the periphery of the receptacle body, said lock ring having camming means for locking the pins in the engaged position when the lock ring is rotated in one direction from a normal non-locking position to a locking position, said lock pins having tapered tips with camming surfaces facing both directions of cap blade movement, said pins being normally held in engaged position by light pin retaining spring means when the lock ring is in unlocked position, so that both insertion and removal of cap blades will cam the lock pins aside, and including stiffer lock spring means associated with each lock pin, for tightly urging the pin toward engaged position only when the lock ring is rotated to its locking position, said lock spring means and tapered lock pin tip serving as emergency releasing means by providing for camming of the lock pin aside when a predetermined pulling force is applied to the cap; and means for manually retracting the pins when it is desired to remove the cap from the receptacle.

6. The receptacle of claim 5 wherein said lock spring means comprises at each lock pin, a leaf type spring oriented perpendicularly to and affixed to the end of the lock pin opposite the tapered end, said lock pin being positioned generally centrally on the leaf type spring, said lock ring camming means, in the locking position of the lock ring, engaging only the ends of the leaf type spring, whereby the leaf type spring deflects when said emergency releasing means is activated.

7. An electrical receptacle adapted to lock a cap to itself by engaging the holes in the blades, comprising:

a receptacle body having slots for insertion of the cap blades and conductors inside for engaging against the cap blades;

a pair of locking pins slidably mounted within the receptacle body so as to be aligned with the respective cap blade holes;

means for engaging the pins in the holes comprising a rotatable lock ring mounted on the periphery of the receptacle body, said lock ring having camming means for locking the pins in the engaged position when the lock ring is rotated in one direction from a normal non-locking position to a locking position;

retraction ring means between the lock ring and the receptacle body for retracting and holding the lock pins when the retraction ring means is rotated in a direction opposite said one direction, said lock ring and retraction ring means having interengaging means for rotating the retraction ring means in said opposite direction when the lock ring is rotated in said opposite direction beyond its normal non-locking position, serving as a means for manually retracting the pins when it is desired to remove the cap from the receptacle; and emergency means for releasing the cap blades from the pins when a predetermined degree of pulling force is applied to the cap.

8. An electrical receptacle adapted to lock a cap to itself by engaging the holes in the blades, comprising:

a receptacle body having slots for insertion of the cap blades and conductors inside for engaging against the cap blades;

a pair of locking pins slidably mounted within the receptacle body so as to be aligned with the respective cap blade holes;

means for engaging the pins in the holes comprising a rotatable lock ring mounted on the periphery of the receptacle body, said lock ring having camming means for locking the pins in the engaged position when the lock ring is rotated in one direction from a normal non-locking position to a locking position;

means for manually retracting the pins when it is desired to remove the cap from the receptacle, including means associated with the lock ring and the lock pins for retracting the lock pins when the lock ring is rotated in a direction opposite said one direction beyond its normal non-locking position, and emergency means for releasing the cap blades from the pins when a predetermined degree of pulling force is applied to the cap.

* * * * *